United States Patent [19]

Scheurecker et al.

[11] 4,215,740

[45] Aug. 5, 1980

[54] STARTER BAR TO BE USED IN CONTINUOUS CASTING PLANTS

[75] Inventors: Werner Scheurecker, Linz; Friedrich Ippisch, Ebensee, both of Austria

[73] Assignee: Voest-Alpine Aktiengesellschaft, Linz, Austria

[21] Appl. No.: 957,664

[22] Filed: Nov. 3, 1978

[30] Foreign Application Priority Data

Dec. 14, 1977 [AT] Austria ..... 8915/77

[51] Int. Cl.[2] ..... B22D 11/08

[52] U.S. Cl. ..... 164/446; 164/426

[58] Field of Search ..... 164/425, 426, 445, 446, 164/82

[56] References Cited

FOREIGN PATENT DOCUMENTS 1925010 11/1970 Fed. Rep. of Germany ..... 164/446
2046531 3/1972 Fed. Rep. of Germany ..... 164/426
2315811 8/1975 Fed. Rep. of Germany .
2716236 11/1977 Fed. Rep. of Germany ..... 164/446

*Primary Examiner*—Robert D. Baldwin
*Assistant Examiner*—Gus T. Hampilos
*Attorney, Agent, or Firm*—Brumbaugh, Graves, Donohue & Raymond

[57] ABSTRACT

A starter bar for continuous casting plants has a starter bar head and linked bodies immediately following the starter bar head and pivotally interlinked by hinge pins. Neighboring linked bodies are provided with recesses at their ends to be penetrated by the hinge pins. The recesses provided at the ends of at least one linked body are open in the longitudinal direction of the starter bar, and tensile-forces-accommodating connecting means are laterally provided on the starter bar to connect the hinge pins at the ends thereof with the linked body whose ends have the open recesses.

7 Claims, 4 Drawing Figures

STARTER BAR TO BE USED IN CONTINUOUS CASTING PLANTS

BACKGROUND OF THE INVENTION

The invention relates to a starter bar to be used in continuous casting plants, which starter bar has a starter bar head and linked bodies, immediately following the starter bar head, which linked bodies are pivotally interlinked by hinge pins that penetrate the engaging ends of neighbouring linked bodies.

In continuous casting plants, due to operational disturbances, a breakthrough of the molten core through the strand skin may occur during casting. The danger of the occurrance of such a breakthrough of the core is particularly great when the plant is started, i.e. while the cast strand is being extracted from the mould with the help of the starter bar. A molten steel core flowing out in such a case welds together the starter bar head, as well as the first linked body immediately following the starter bar head, with the strand guiding rollers that define the strand guiding path. Repair requires a lot of time and work because access to these parts is poor. At first, the undamaged part of the starter bar must be separated from that part which has welded together with the stationary parts of the plant. Hitherto, this was done by destroying a linked body of the starter bar by a torchcutting step, whereby additional costs are incurred.

There is a further problem with continuous casting plants which are equipped for producing cast strands of various thicknesses. With such plants, the same starter bar can be used for strands of various thicknesses within certain ranges of thickness by exchanging one starter bar head for another starter bar head corresponding to the respective casting thickness and connecting it to the linked bodies of the starter bar. If the difference in thickness between the new starter bar head and the linked bodies is very pronounced, a number of transitional linked bodies widening in a wedge-like manner towards the starter bar head must be provided. These transitional bodies must be exchanged together with the starter bar head when a new casting thickness is desired.

It is known to give the hinge pins connecting the linked bodies a multiple-part design so as to anchor one hinge pin portion on the projections of a linked body and to let the ends of each hinge pin portion engage in grooves incorporated in the projections of the neighbouring linked body. There, the grooves extend at an angle to the longitudinal axis of the linked bodies or starter bar. By pivoting up and moving one of the linked bodies along the groove, it is possible to disassemble the starter bar into parts. With this construction, however, it is not possible to separate in a simple manner the linked bodies of the starter bar which have not welded together, from those linked bodies which have welded together with the plant during a breakthrough of the core. This is so because it is not possible to pivot up one of the linked bodies as long as the starter bar is in the strand guiding path. In this case also, one of the linked bodies must be destroyed in order to divide the starter bar. Also, an exchange of the starter bar head is complicated, since it must first be pivoted up to accomplish an exchange and thus an increased utilization of the hall crane is necessary.

With a starter bar of the above-defined kind, it is furthermore known to design at least one linked body so as to be divided between the hinges connecting it with its neighbouring linked bodies, the linked-body parts being clamped together with laterally arranged connecting elements. Due to these divisible linked bodies, the starter bar can be divided without destroying a linked body, even if it is still in the strand guiding path.

Since in modern curved continuous casting plants the extraction forces are applied by pairs of driving rollers provided in the curved portion of the strand guiding path, which pairs of driving rollers are adjustable to the strand or to the starter bar, respectively, the linked bodies are subjected to a bending strain when passing through such a pair of driving rollers. With a divisible starter bar of the kind with lateral connecting elements that has just been described, there results a high bending strain precisely at the line of division of the linked body, which means an unfavorable wear at this point. Thus the lateral connecting elements are subjected to additional wear by the forces resulting from this bending strain, and have to be dimensioned to withstand these additional forces.

SUMMARY OF THE INVENTION

The present invention aims at avoiding the disadvantages of prior starter bars has as its object to provide a starter bar which can easily be divided transverse to its longitudinal axis into two or more parts, without involving great costs and amounts of work, and, in particular, without destroying one of the linked bodies. This object is to be accomplished even if it is within the strand guide and the places of division are to be free of bending moments.

According to the invention, this object is achieved in that the recesses at the ends of two brackets forming at least one linked body are designed to be open in the longitudinal direction of the starter bar, and that the hinge pin at these ends is connected with this linked body by means of tensile-forces-accommodating connecting means laterally arranged on the starter bar.

It is advantageous if those ends of the brackets of a neighboring linked body which engage with the ends having the open recesses are provided with closed recesses which surround the hinge pin in the longitudinal direction of the starter bar.

The open recesses suitably are designed as slots whose common middle plane is directed parallel to the broad side of the linked body.

Advantageously, the connecting means, in the thickness direction of the starter bar, are not as high as the linked bodies, so the driving rollers are still spaced a certain distance from the connecting means, even after the starter bar has been worn to a certain extent. As a result the driving rollers and do not subject the connecting means to a bending strain.

According to a suitable embodiment, brackets with eyes at their ends are provided as connecting means, by which the two hinge pins of the linked body having the open recesses are interconnected.

According to another advantageous embodiment, bolts, each having a head with an eye, are provided as connecting means, and thus the articulated connection of two interlinked bodies is adjustable and can be freed from play.

Suitably, one of the two side walls of the open recess in a linked body is extended and, when the starter bar is straightened, contacts an abutment pin arranged on the neighbouring linked body, parallel to the hinge pin.

BRIEF DESCRIPTION OF THE DRAWINGS

The invention will now be described in more detail by way of two embodiments and with reference to the accompanying drawings, wherein.

DESCRIPTION OF PREFERRED EMBODIMENTS

Figure 1:
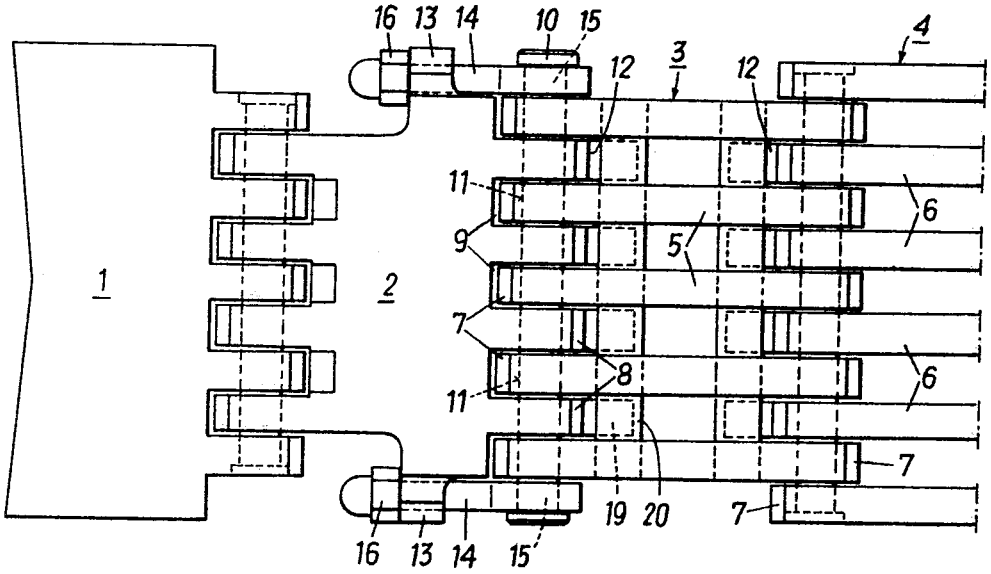
FIG. 1 is a top view of the head end of the starter bar.
Figure 2:
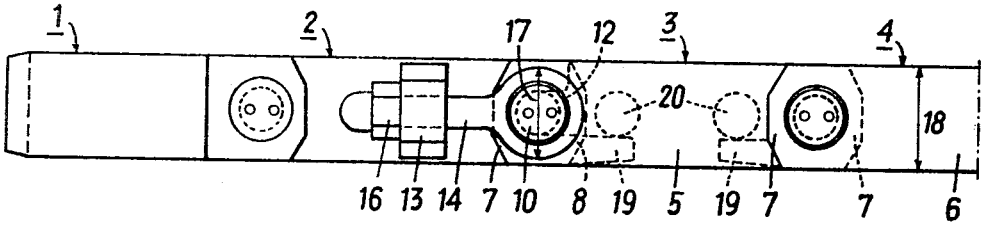
FIG. 2 is a side view of the head end according to one embodiment of the invention.

A starter bar head 1 is connected to a chain of pivotally linked bodies 3, 4 by means of a transitory linked body 2. Each linked body 3, 4 is formed by members or brackets, 5, 6 respectively, lying parallel to each other, the ends 7 of which engage and are interconnected by hinge pins penetrating them. The ends 7 of the linked body 3 neighbouring the transitory body 2, which may also be referred to as a linked body, and facing it, engage in recesses 9 of the transitory body 2, which recesses 9 are provided between the ends 8.

These ends 8 are also pivotally connected with the ends 7 of the brackets 5 by means of a hinge pin 10. For accommodating the hinge pin 10, the ends 7 of the brackets 5 are provided with bores 11, whereas the projections 8 of the transitory body 2 are provided with slots 12 open in the longitudinal direction of the same. The slots 12 have a middle plane extending in the longitudinal direction of the straightened starter bar and parallel to the broad side of the transitory body 2. The transitory body 2 furthermore is provided with consoles 13 at both of its narrow sides, which consoles form an abutment for bolts 14. Bolts 14 are each provided with an eye in their head for surrounding an end 15 of the hinge pin 10. These bolts may be tightened relative to the consoles 13 by means of a nut 16. The greatest dimension 17 of the bolt, taken in the direction of the thickness of the starter bar, is less than the thickness 18 of the starter bar, so that pressure forces do not act on the eye bolts when the starter bar is strained by driving rollers provided in a strand guiding path of a continuous casting plant. The pressure forces are accommodated by the ends 7 and 8 alone. For dividing the starter bar, only the nuts 16 need be loosened, whereupon the starter bar head 1 together with the transitory body 2 can be detached from the remaining linked bodies of the starter bar by a movement along the longitudinal axis of the starter bar or of the strand guiding path, respectively. If the loosening of the nuts 16 is too complex or cannot be carried out because of poor access, e.g. if the starter bar is stuck in the strand guiding path and the starter bar head has welded together with the strand guiding path because of a breakthrough of the strand core, the eye bolts 14 can be parted by torch-cutting. In order to make this possible without damaging the linked bodies, the consoles and the hinge pins, the consoles 13 are arranged at a distance from the hinge pin 10.

One of the two side walls forming the slot 12 is extended. This extension 19 comes into contact with an abutment pin 20 arranged parallel to the hinge pin 10 on the linked body 3, whenever the starter bar is straightened. Thereby, the brackets of the linked body 3 are precisely aligned relative to each other and to the transitory body 2, so that assembly of the starter bar is facilitated. The extensions then constitute slide paths for guiding the hinge pin 10. Furthermore, bending of the starter bar beyond its straightened position is effectively avoided.

Figure 3:
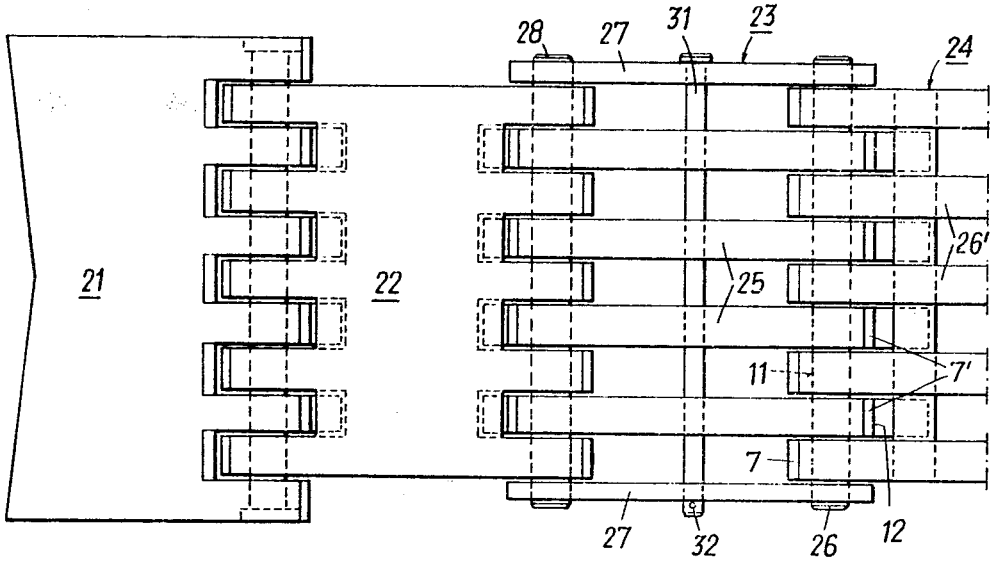
FIGS. 3 and 4 show a further embodiment in illustrations analogous to those of FIGS. 1 and 2.
Figure 4:
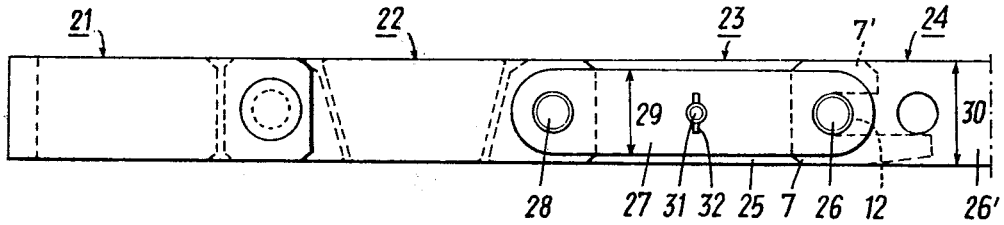

According to the embodiment illustrated in FIGS. 3 and 4, the starter bar head 21—via a transitory body 22—is connected to a chain of interconnected linked bodies 23, 24. Each one of the linked bodies 23, 24 is assembled of members or brackets 25 and 26', respectively, whose ends 7, 7' overlap with the brackets of the neighbouring linked body.

The ends 7' of the brackets of the linked body 23 are provided with open slots 12, whereas the ends 7 of the brackets 26' of the linked body 24 have bores 11 penetrated by a hinge pin 26. At both sides of the starter bar, tensile-forces-accommodating connecting brackets 27 are provided, which brackets each embrace the hinge pin 26 with one of their ends and the hinge pin 28, provided between the linked body 23 and the transitory linked body 22, with the other one of their ends. The height 29 of the connecting brackets 27, taken in the thickness direction of the starter bar, is less than the height 30 of the linked bodies 23 and 24, which height 30 corresponds to the thickness of the starter bar.

For better centering of the brackets 25 and the connecting brackets 27 relative to each other when the starter bar has been separated, i.e. when that portion of the starter bar assembled of parts 21 to 23 has been separated from the remaining portion of the same, which centering is particularly necessary when the two portions of the starter bar are reassembled, the connecting brackets 27 and the brackets 25 of the linked body 23 are penetrated by a pin 31 that is secured in place by a peg 32.

For separating the starter bar, the pin 31 has to be withdrawn after removal of the peg 32, whereupon the brackets 27 can be removed from the pins 26, 28. Then the starter bar head 21, the transitory body 22 and the linked body 23 can be drawn away from the remaining portion of the starter bar in the longitudinal direction of the starter bar or of the strand guiding path, respectively. If it is not possible to remove the pin 31, the brackets 27 can be parted by torch-cutting, whereby the starter bar is also divisible into two portions.

The number of the divisible hinge points on a starter bar depends on the respective demands. Thus, if an easy exchange of individual linked bodies is required, the starter bar can be designed so as to be divisible at each of its hinge points.

We claim:

1. In a starter bar to be used in continuous casting plants and of the type including a starter bar head, linked bodies immediately following said starter bar head, and hinge pin means pivotally interlinking said linked bodies into a chain, each linked body being formed of substantially parallel members connected together, neighbouring ones of said linked bodies having members with engaging ends provided with overlapping recesses and pertaining hinge pin means penetrating said recesses, the improvement which is characterized in that the recesses provided at the ends of the members of at least one of said linked bodies are open in the longitudinal direction of the starter bar, and that tensile-forces-accommodating connecting means are laterally arranged on said starter bar for connecting the ends of the hinge pin means adjacent the open recesses with said at least one linked body with open recesses.

2. A starter bar as set forth in claim 1, wherein the ends of the members of a linked body engaging with the ends of the members of said at least one linked body with open recesses, have recesses surrounding the hinge pin means in the longitudinal direction of the starter bar.

3. A starter bar as set forth in claim 1, wherein said recesses provided at the ends of the members of said at least one linked body with open recesses, are designed as slots having a common middle plane directed parallel to the broad side of said at least one linked body.

4. A starter bar as set forth in claim 1, wherein said tensile-forces-accommodating connecting means, taken in the thickness direction of the starter bar, are not as high as the linked bodies.

5. A starter bar as set forth in claim 1, wherein said recesses provided at the ends of the members of said at least one linked body with open recesses, are formed by two side walls each, one of said two side walls being extended, an abutment pin being provided on the neighbouring linked body parallel to the hinge pin means, said extended one of said two side walls contacting said abutment pin when the starter bar is straightened.

6. In a starter bar to be used in continuous casting plants and of the type including a starter bar head, linked bodies immediately following said starter bar head, and hinge pin means pivotally interlinking said linked bodies into a chain, each linked body being formed of substantially parallel members connected together, neighbouring ones of said linked bodies having members with engaging ends provided with overlapping recesses and pertaining hinge pins means penetrating said recesses, the improvement which is characterized in that the recesses provided at the ends of the members of at least one of said linked bodies are open in the longitudinal direction of the starter bar and that tensile forces-accommodating brackets having eyes at their ends are laterally arranged on said starter bar for connecting the ends of the hinge pin means adjacent the open recesses with said at least one linked body with open recesses, the hinge pin means at opposite ends of said at least one linked body with open recesses being positioned within the respective eyes of said bracket so as to be interconnected by said brackets.

7. In a starter bar to be used in continuous casting plants and of the type including a starter bar head, linked bodies immediately following said bar head, and hinge pin means pivotally interlinking said linked bodies into a chain, each linked body being formed of substantially parallel members connected together, neighbouring ones of said linked bodies having members with engaging ends provided with overlapping recesses and pertaining hinge pin means penetrating said recesses, the improvement which is characterized in that the recesses provided at the ends of the members of at least one of said linked bodies are open in the longitudinal direction and that tensile-forces-accommodating bolts, each having a head with an eye therein, are laterally arranged on said starter bar for connecting the ends of the hinge pin means adjacent the open recesses with said at least one linked body with open recesses, the ends of the hinge pin means adjacent the open recesses being positioned within the eyes of the bolts and the ends of the bolts being fastened to said at least one linked body with open recesses.

* * * * *